US007909742B2

(12) United States Patent
Ish, III et al.

(10) Patent No.: US 7,909,742 B2
(45) Date of Patent: Mar. 22, 2011

(54) FUNCTIONAL TRAINING EXERCISE APPARATUS AND METHODS

(75) Inventors: A. Buell Ish, III, Redmond, WA (US); L. Kent Lines, Carnation, WA (US); Jose L. Sanchez, Bothell, WA (US); Robert A. Rasmussen, Bellevue, WA (US)

(73) Assignee: Vectra Fitness, Inc., Redmond, WA (US)

( * ) Notice: Subject to any disclaimer, the term of this patent is extended or adjusted under 35 U.S.C. 154(b) by 0 days.

(21) Appl. No.: 11/833,220

(22) Filed: Aug. 2, 2007

(65) Prior Publication Data

US 2009/0036277 A1 Feb. 5, 2009

(51) Int. Cl.
*A63B 21/00* (2006.01)
*A63B 21/06* (2006.01)
*A63B 21/08* (2006.01)

(52) U.S. Cl. ..... 482/97; 482/92; 482/93; 482/94

(58) Field of Classification Search ..... 482/908, 482/38–39, 92–139
See application file for complete search history.

(56) References Cited

U.S. PATENT DOCUMENTS 1,535,391 A * 4/1925 Anderson ..... 482/117
3,782,721 A * 1/1974 Passera ..... 482/117
3,858,873 A * 1/1975 Jones ..... 482/97
4,415,063 A * 11/1983 Hutchison ..... 182/230
4,505,475 A * 3/1985 Olschansky et al. ..... 482/100
4,603,855 A * 8/1986 Sebelle ..... 482/103
4,666,149 A * 5/1987 Olschansky et al. ..... 482/130
4,684,125 A * 8/1987 Lantz ..... 482/112
4,844,456 A * 7/1989 Habing et al. ..... 482/100
4,858,915 A * 8/1989 Szabo ..... 482/97
4,973,043 A * 11/1990 Nolan ..... 482/45
5,419,749 A * 5/1995 Morgenstein ..... 482/99
5,921,902 A * 7/1999 Carpenter ..... 482/139
6,238,323 B1 5/2001 Simonson
6,387,020 B1 * 5/2002 Simonson ..... 482/99
6,443,874 B1 * 9/2002 Bennett ..... 482/44
6,443,877 B1 * 9/2002 Hoecht et al. ..... 482/103
6,458,061 B2 * 10/2002 Simonson ..... 482/103
6,488,612 B2 * 12/2002 Sechrest et al. ..... 482/103
6,508,748 B1 * 1/2003 Ish, III ..... 482/100
6,592,498 B1 * 7/2003 Trainor ..... 482/97
6,692,416 B1 * 2/2004 Davis ..... 482/139
6,712,740 B2 * 3/2004 Simonson ..... 482/99
7,169,093 B2 * 1/2007 Simonson et al. ..... 482/103
7,179,209 B2 * 2/2007 Sechrest et al. ..... 482/103
7,282,016 B2 * 10/2007 Simonson ..... 482/103
2001/0023221 A1 * 9/2001 Simonson ..... 482/103
2002/0013200 A1 * 1/2002 Sechrest et al. ..... 482/98

(Continued)

*Primary Examiner* — Rinaldi I Rada
*Assistant Examiner* — Robert F Long

(57) ABSTRACT

Exercise apparatus and methods are disclosed herein. In one embodiment, an exercise assembly includes a load, a support assembly, a force-transferring assembly operatively coupled to the load and to the support assembly, and an exercise station operatively coupled to the force-transferring assembly. The exercise station includes a user interface, at least one adjustment assembly configured to adjust a position of the user interface, and an actuator assembly selectively engageable with the at least one adjustment assembly. The actuator assembly is configured to approximately simultaneously enable vertical and horizontal adjustment of the user interface when the actuator assembly is actuated to release the at least one adjustment assembly, and to approximately simultaneously disable adjustment of the user interface when the actuator assembly is actuated to lock the at least one adjustment assembly. Thus, movements of the user interface may be easily and efficiently performed using a single-touch actuation assembly.

18 Claims, 11 Drawing Sheets

U.S. PATENT DOCUMENTS

2003/0017918 A1* 1/2003 Webb et al. ..... 482/94
2003/0032530 A1* 2/2003 Sechrest et al. ..... 482/94
2003/0032531 A1* 2/2003 Simonson ..... 482/103
2005/0202941 A1* 9/2005 Vaes ..... 482/94
2006/0100069 A1* 5/2006 Dibble et al. ..... 482/98
2006/0160676 A1* 7/2006 Sato ..... 482/94
2006/0189457 A1* 8/2006 Ripley ..... 482/99
2007/0093364 A1* 4/2007 Batca ..... 482/99
2007/0117691 A1* 5/2007 Sechrest et al. ..... 482/97
2007/0161468 A1* 7/2007 Yanagisawa et al. ..... 482/94
2007/0167299 A1* 7/2007 Simonson et al. ..... 482/100
2007/0173384 A1* 7/2007 Sechrest et al. ..... 482/99
2008/0020912 A1* 1/2008 Dalebout et al. ..... 482/129
2008/0051263 A1* 2/2008 Rasmussen et al. ..... 482/94
2008/0300116 A1* 12/2008 Eder ..... 482/100

* cited by examiner

FUNCTIONAL TRAINING EXERCISE APPARATUS AND METHODS

FIELD OF THE INVENTION

The present disclosure relates to exercise equipment, and more specifically, to exercise equipment for improved functional training exercises.

BACKGROUND

The advantages of weight-training exercise machines are widely recognized. Conventional weight-training exercise machines may feature single or multiple stations which enable a user to perform one or a variety of exercises for developing and toning different muscle groups. For example, the various stations of such exercise machines may include one or more stations that enable a user to exercise muscles of the arms and upper body using "press," "shrug," or "curl" types of movements, and one or more stations for exercising muscles of the legs using "squat," "press," or "extension" types of movements. Such weight machines provide the desired muscle training capability in a convenient, safe, and efficient manner.

Although prior art apparatus enable a user to exercise a variety of different muscle groups using a variety of different movements, the standard movements afforded by such apparatus (e.g. press, shrug, curl, squat, extension, etc.) may not closely resemble the actual movements associated with the user's chosen activity. Therefore, exercise systems and methods that more closely approximate the movements associated with the user's chosen activity would have utility.

SUMMARY

Embodiments of apparatus and methods in accordance with the present disclosure provide user interfaces that are adjustable using a single-touch actuation assembly that enables a user to easily and efficiently release, move, and lock such user interfaces throughout a three-dimensional range of motion. More specifically, embodiments in accordance with the present disclosure allow the vertical and horizontal (or elevational and azimuthal) positions of the user interface to be adjusted either sequentially or simultaneously using a convenient, single-touch actuation assembly. Such embodiments may advantageously improve the ease with which the user may adjust both the vertical and horizontal positions of the user interface for performing an exercise, and may also provide improved positioning capabilities for the user to perform desired exercises, including functional training exercises associated with the user's chosen activity.

In one embodiment, an exercise assembly includes a load, a support assembly operatively positioned relative to the load, a force-transferring assembly operatively coupled to the load and to the support assembly, and an exercise station operatively coupled to the force-transferring assembly. The exercise station includes a user interface, at least one adjustment assembly configured to adjust a position of the user interface, and an actuator assembly selectively engageable with the at least one adjustment assembly. The actuator assembly is configured to approximately simultaneously enable adjustment of the user interface in a vertical direction and in a horizontal direction when the actuator assembly is actuated to release the at least one adjustment assembly, and to approximately simultaneously disable adjustment of the user interface in the vertical and horizontal directions when the actuator assembly is actuated to lock the at least one adjustment assembly.

In further embodiments, the exercise station includes an arm operatively coupled to the at least one adjustment assembly, the user interface being positioned on the arm, and the at least one adjustment assembly being configured to adjust an elevation angle and an azimuth angle of the arm.

In another embodiment, a method of performing an exercise includes selecting a training load, and actuating an actuator to enable movement of a user interface of an exercise station. Actuating the actuator includes approximately simultaneously enabling movement of the user interface vertically and horizontally. The method includes moving the user interface to a desired position, actuating the actuator to prevent movement of the user interface, and applying a training force to the training load via the user interface.

BRIEF DESCRIPTION OF THE DRAWINGS

Embodiments of the invention are described in detail below with reference to the following drawings.

DETAILED DESCRIPTION

The present disclosure teaches exercise apparatus and methods for improved functional training exercises. Many specific details of certain embodiments of the invention are set forth in the following description and in FIGS. 1-15 to provide a thorough understanding of such embodiments. One skilled in the art, however, will understand that the present invention may have additional embodiments, or that the present invention may be practiced without several of the details described in the following description.

In general, embodiments of exercise apparatus and methods in accordance with the present invention provide improved capabilities for a user to perform exercises, and more specifically, to perform functional training exercises associated with the user's chosen activity. As used in this disclosure, the term functional training exercise (or movement) refers to movements for training the body the way it will be used in activities of daily living, including movements associated with sports, or movements associated with a user's work, hobby, or therapeutic activities. Examples of functional training movements include, but are not limited to, torso bending and twisting movements, pushing and pulling movements, and sporting movements such as swinging a sporting apparatus (e.g. a bat, racquet, stick, golf club, etc.), throwing or tossing a sporting device (e.g. a baseball, shot put, discus, football, etc.), kicking motions (e.g. kicking a ball, karate motions, etc.), head and torso motions, jumping motions, or any other desired functional training movements.

In the following discussion, several exemplary embodiments of apparatus and methods in accordance with the disclosure are described. More specifically, an embodiment of an exercise assembly having two adjustment assemblies per exercise station is described first. Next, embodiments of methods of exercising in accordance with the present disclosure are described. Finally, a description of an exercise assembly having a single adjustment assembly for each exercise station is described. It will be appreciated, of course, that the following discussion of embodiments is not an exhaustive list of all possible embodiments, and that additional embodiments of apparatus and methods in accordance with the present disclosure may be conceived based on the teachings herein.

Figure 1:
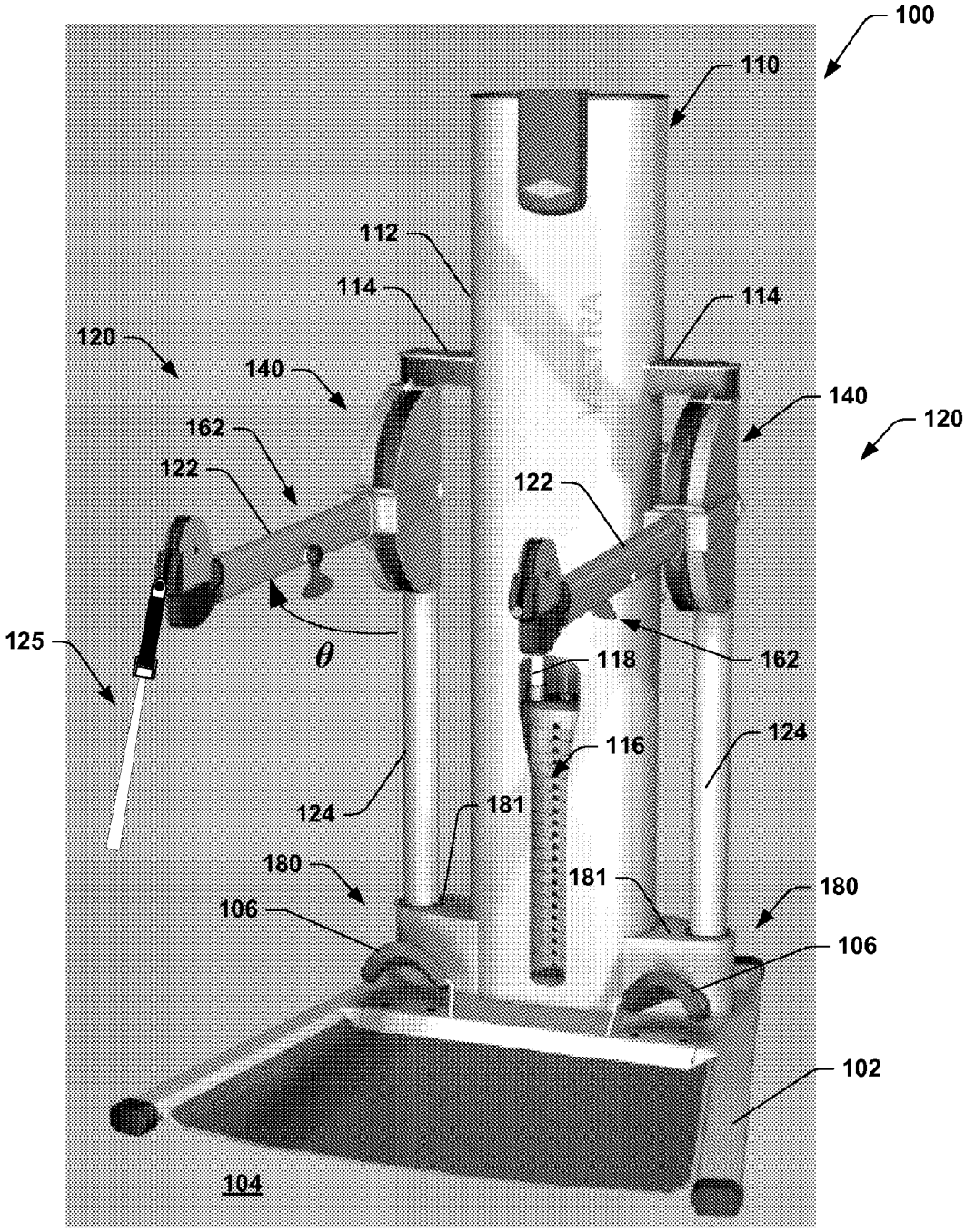
FIG. 1 is an isometric view of an exercise assembly in accordance with an embodiment of the invention.

FIG. 1 is an isometric view of an exercise assembly 100 in accordance with an embodiment of the invention. In this embodiment, the exercise assembly 100 includes an upwardly extending central portion 110 coupled to a base assembly 102 that rests on a support surface 104 (e.g. a floor). The base assembly 102 may include foot engagers 106 for securing a user's feet during an exercise, as described in co-pending, commonly-owned U.S. patent application Ser. No. 11/771,738 filed on Jun. 29, 2007, which application is incorporated herein by reference. In the embodiment shown in FIG. 1, the central portion 110 includes a shield member 112 and a pair of support members 114 that extend laterally outwardly from the shield member 112. A weight stack 116 is positioned within the shield member 112, each weight of the weight stack 116 being slideably mounted on one or more guide rods 118 (FIGS. 1 and 2) that are disposed within the shield member 112.

As further shown in FIG. 1, the exercise assembly 100 includes a pair of exercise stations 120 that enable a user to perform a variety of exercises, including functional training exercises. More specifically, each exercise station 120 includes an arm 122 coupled to an upright support 124 by a first adjustment assembly 140. An exercise handle 125 may be coupled proximate a distal end of the arm 122 to a force-transfer assembly (not visible), operatively coupling the exercise handle 125 to the weight stack 116. The upright support 124 extends from the support member 114 of the central portion 110 to a second adjustment assembly 180 proximate the base assembly 102. The first and second adjustment assemblies 140, 180 of the exercise station 120 advantageously provide substantially improved adjustability of the position of the arm 122 (and thus the exercise handle 125) for performing exercises, as described more fully below.

It will be appreciated that, in alternate embodiments, the first and second adjustment assemblies 140 180 may be relocated to any suitable positions, and that the invention is not limited to the particular exercise assembly embodiment shown in FIG. 1. For example, in alternate embodiments, the second adjustment assembly may be moved up to be adjacent to (above, below, or beside) the first adjustment assembly near the end of the arm 122, and the upright support 124 may be eliminated. In still other embodiments, the functionalities of the first and second adjustment assemblies may be combined into a single adjustment assembly.

It will also be appreciated that any desired exercise handle may be used in the exercise station 120 for performing any desired exercise. In the particular embodiment shown in FIG. 1, the exercise handle 125 is an elongated handle having a configuration like that of a handle of a golf club. In alternate embodiments, however, the exercise handle 125 may be configured in any desired shape, including a racquet handle, a baseball bat handle, a baseball, a hockey stick handle, or any other suitable functional training interface. Specific embodiments of functional training interfaces that may be used in conjunction with the exercise station 120 include those training interfaces (or handles) described in previously-incorporated U.S. patent application Ser. No. 11/771,738 filed on Jun. 29, 2007.

Figure 2:
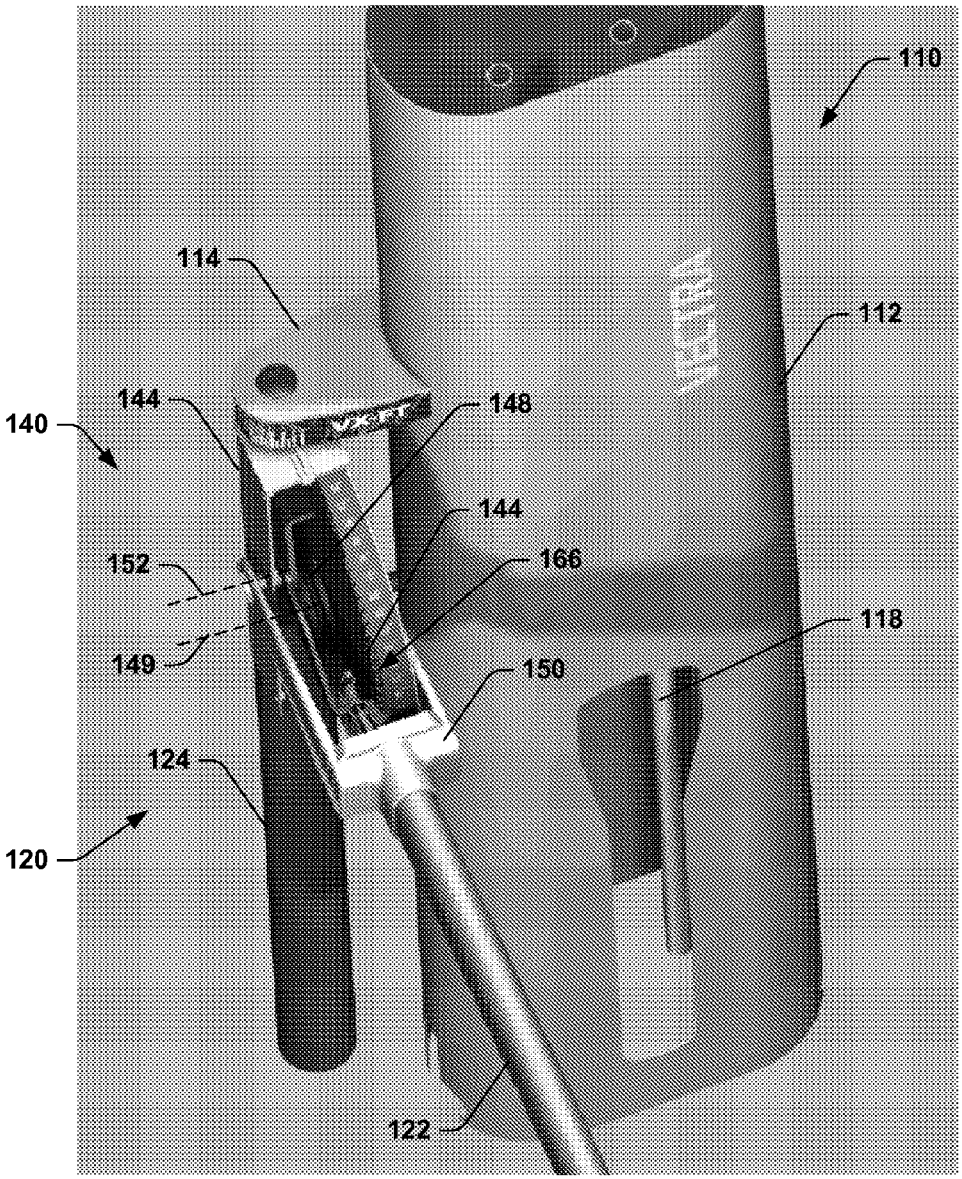
FIGS. 2 and 3 are enlarged, partial cutaway views of an upper adjustment assembly of an arm of the exercise assembly of FIG. 1.
Figure 3:
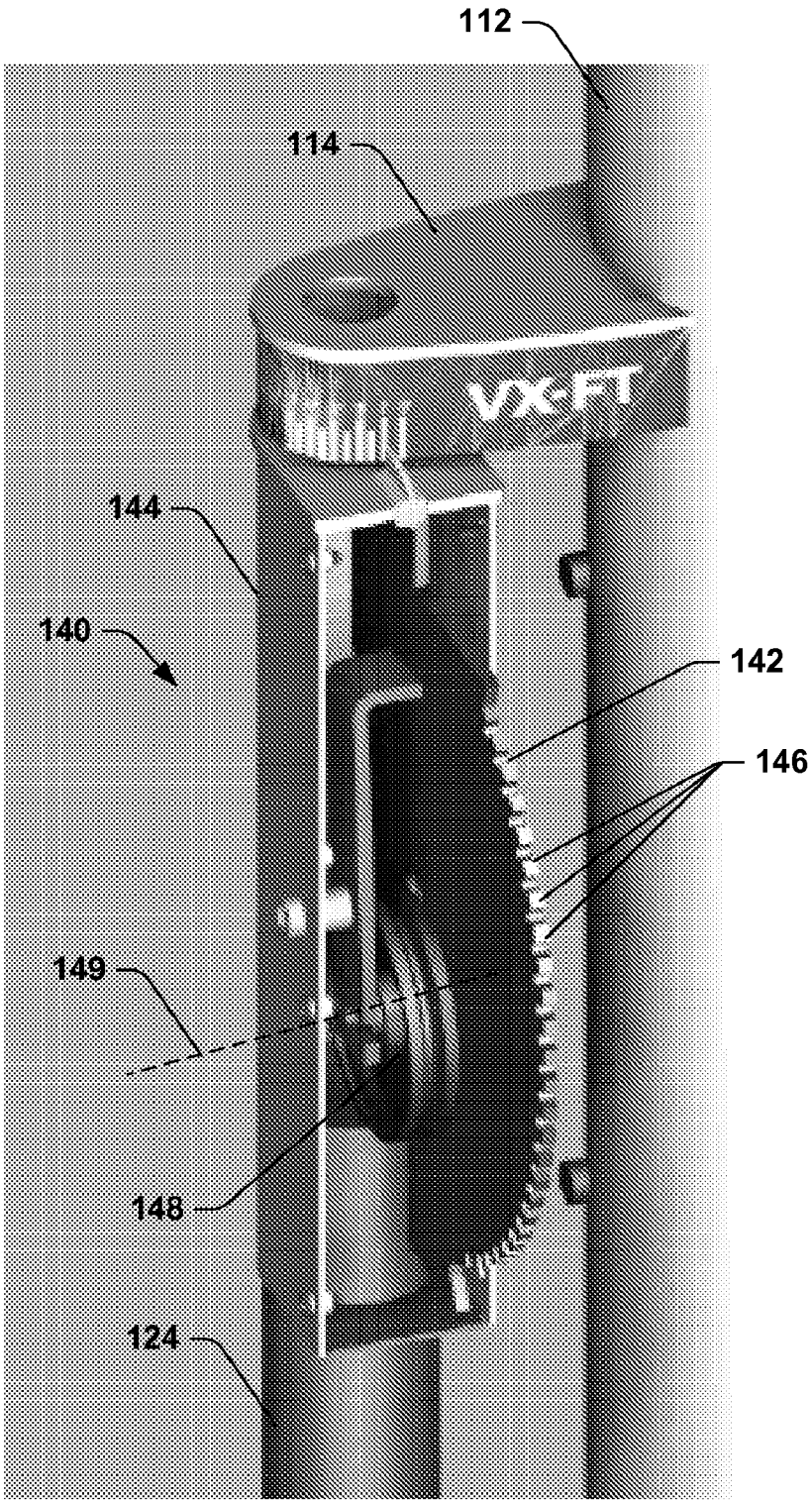

FIGS. 2 and 3 are enlarged, partial cutaway views of the first adjustment assembly 140 of one of the exercise stations 120 of the exercise assembly 100 of FIG. 1. It will be appreciated that the first adjustment assemblies 140 of the left and right exercise stations 120 may be configured in substantially the same (or similar) configuration, (or even as identical or mirror image configurations), and therefore, for the sake of brevity, only one of the first adjustment assemblies 140 will be described in detail. In this embodiment, the first adjustment assembly 140 includes an arcuate indexing member 142 partially disposed within a first housing 144 coupled to the upright support 124. As best shown in FIG. 3, the indexing member 142 includes a plurality of indexing slots 146 disposed along an arcuate edge thereof. An upright guide pulley 148 is positioned proximate the indexing member 142 and rotatably secured within the upper housing 144. The upright guide pulley 148 is rotatable about a pulley rotation axis 149. In alternate embodiments, the indexing member 142 and indexing slots 146 may be replaced with any other suitable means of indexing, such as holes, teeth, electromagnetic devices, frictional devices, or any other suitable indexing devices.

Figure 4:
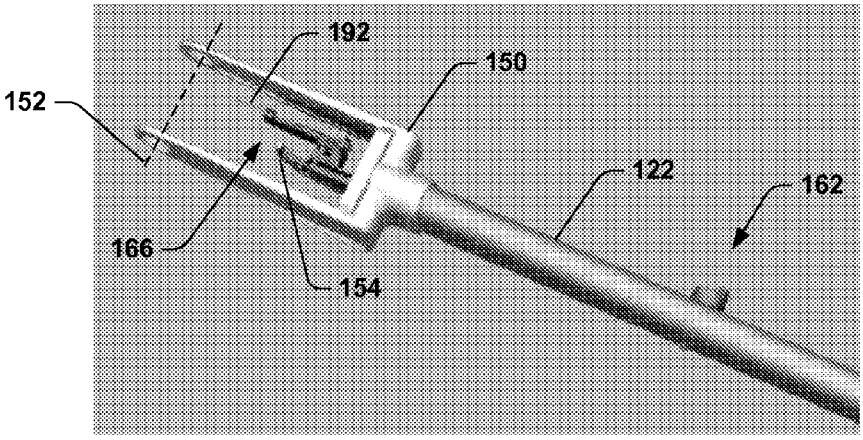
FIGS. 4 and 5 are isometric partial views of the arm coupled to a fork member of the upper adjustment assembly of FIG. 2.
Figure 5:
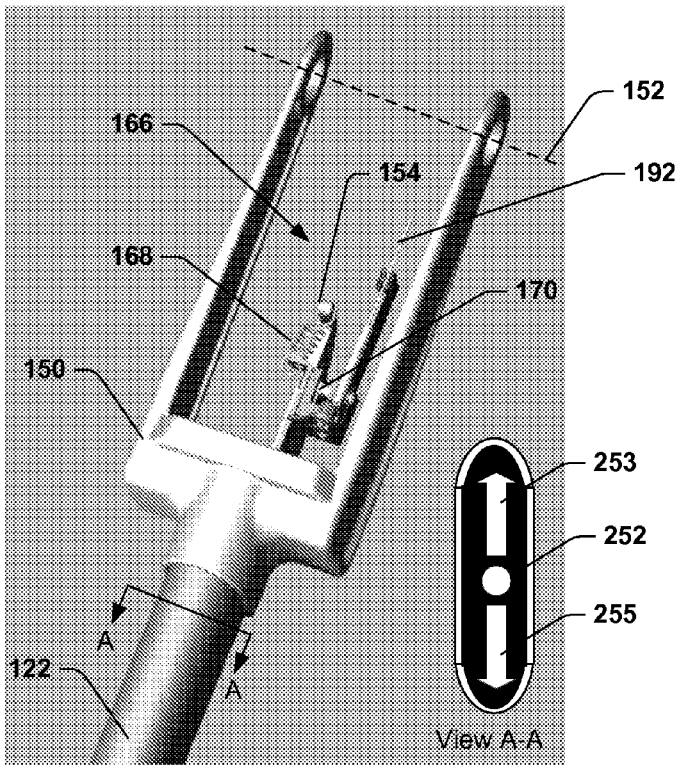

The first adjustment assembly 140 further includes a fork member 150 that is coupled to an end portion of the outwardly-extending arm 122. FIGS. 4 and 5 are isometric partial views showing the arm 122 coupled to the fork member 150. The fork member 150 is pivotably coupled to the first housing 144 such that the fork member 150 (and the arm 122) pivots about an arm pivot axis 152. As best shown in FIG. 2, the arm pivot axis 152 may be offset from the pulley rotation axis 149 to provide improved functionality of the first adjustment assembly 140, as described more fully below.

Figure 6:
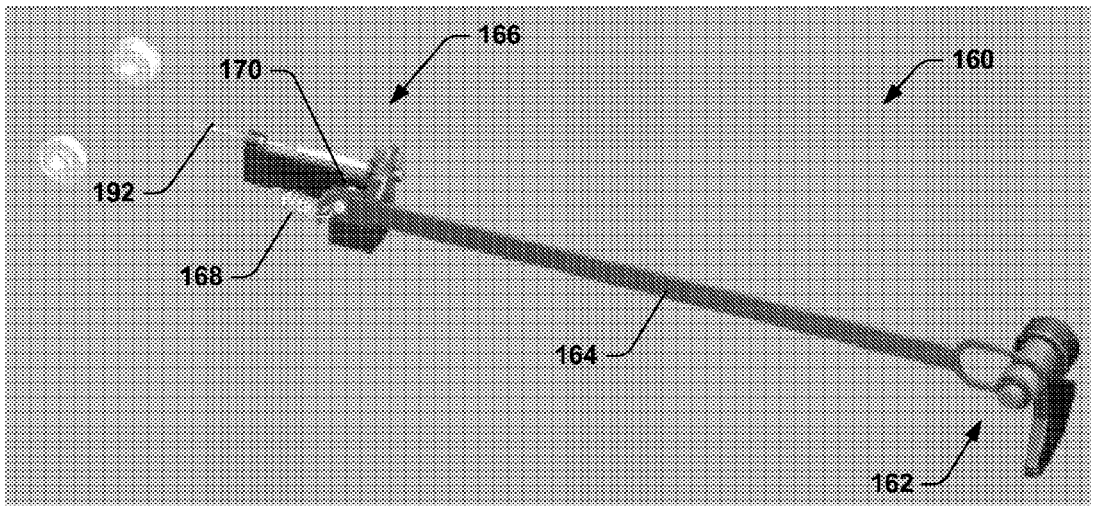
FIGS. 6 and 7 are enlarged partial views of an actuator assembly of the exercise station of FIG. 1.
Figure 7:
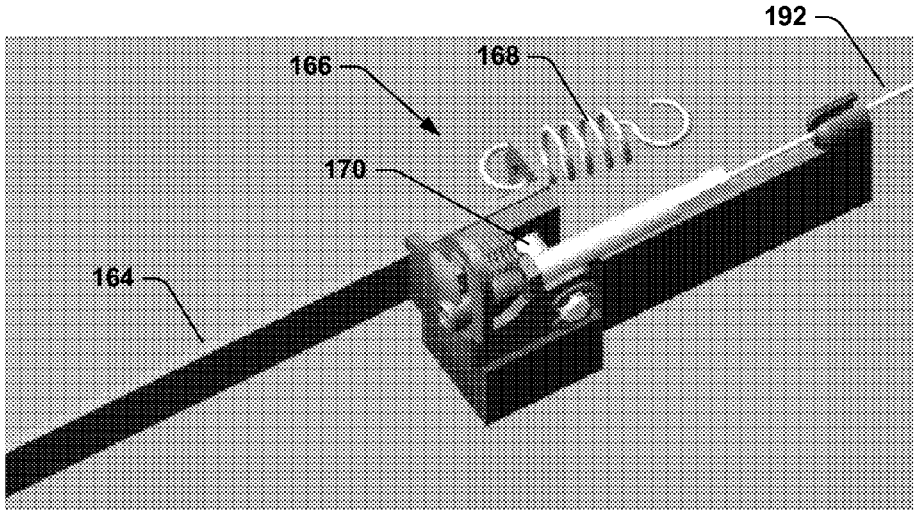

In the exercise machine 100 of FIG. 1, the position of the arm 122 may be controllably adjusted by a user using the first adjustment assembly 140 by means of an actuator assembly 160 that extends through (or along) the arm 122. FIGS. 6 and 7 show enlarged views of the actuator assembly 160 that engages and disengages the first adjustment assembly 140 so that the position of the arm 122 may be adjusted.

As best shown in FIG. 6, in this embodiment, the actuator assembly 160 includes a handle portion 162 that extends outwardly from the arm 122 (FIG. 1) at a distal location that is spaced apart from the first adjustment assembly 140. An actuation member 164 extends between the handle portion 162 and a release mechanism 166 that engages the arcuate indexing member 142 of the first adjustment assembly 140. As best shown in FIG. 5, the release mechanism 166 includes a return spring 168 that is coupled between an end portion of the actuation member 164 and a support tine 154 of the fork member 150. The return spring 168 biases an engagement portion (or cross pin) 170 (FIG. 7) of the release mechanism 166 into locking engagement with the indexing slots 146 of the indexing member 142.

The handle portion 162 may be configured in a variety of different ways, including, for example, as disclosed in commonly-owned U.S. Pat. No. 6,508,748 issued to Ish, which issued patent is incorporated herein by reference. More specifically, in some embodiments, the handle portion 162 may be configured to actuate the release mechanism 166 when the handle portion 162 is rotated in either the forward or rearward rotational directions from an initial resting position, and to de-actuate the release mechanism 166 when the handle portion 162 is returned to the initial (or non-actuated) position. Alternately, the handle portion 162 may be configured to actuate the release mechanism 166 only when the handle portion 162 is rotated in a first rotational direction (either forward or rearward), and may be further configured to de-actuate the release mechanism 166 when the handle portion 162 is rotated in an opposite (or second) rotational direction. Of course, in further embodiments, any other suitable handles may be used, including non-rotating handles such as push-pull devices, push-button devices, electromechanical devices, lever devices, and hand brake devices, and any other suitable actuation devices.

Figure 8:
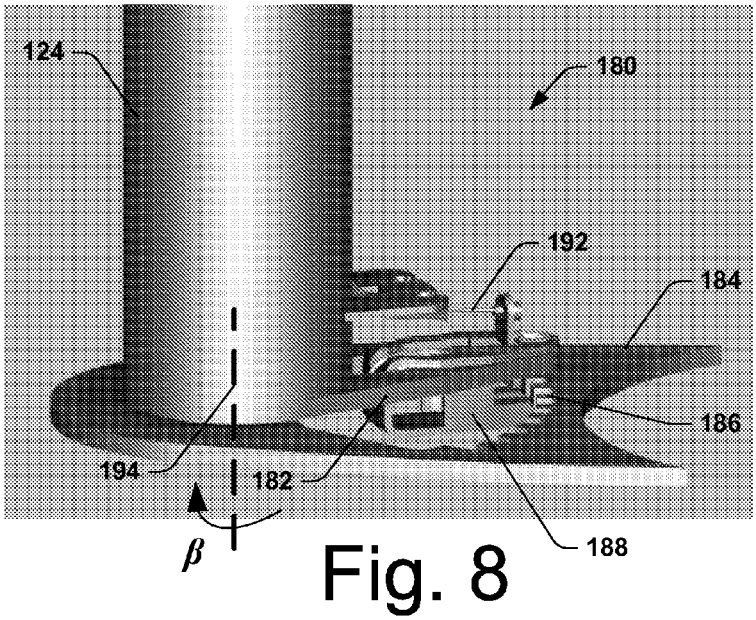
FIGS. 8 and 9 are enlarged isometric views of a lower adjustment assembly of the exercise station of the exercise assembly of FIG. 1.
Figure 9:
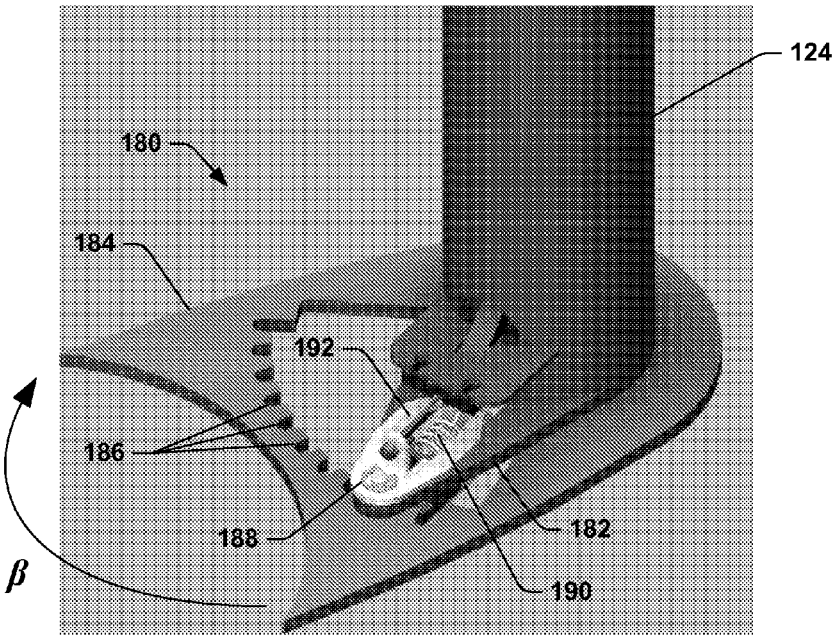

FIGS. 8 and 9 are enlarged, partial isometric views of the second adjustment assembly 180 (with a second housing 181 of FIG. 1 removed) of the exercise station 120 of FIG. 1. As with the first adjustment assemblies 140, the second adjustment assemblies 180 may be configured in substantially the same (or similar) configuration, (or even as identical or mirror image configurations), and therefore, for the sake of brevity, only one of the second adjustment assemblies 180 will be described in detail. In this embodiment, the second adjustment assembly 180 includes a support bracket 182 coupled to and projecting outwardly from the upright support 124, and an indexing bracket 184 having a plurality of indexing slots 186 disposed along an arcuate edge thereof. A locking member 188 is slideably engaged with the support bracket 182, and is biased into engagement with the indexing slots 186 by a locking spring 190 (FIG. 9).

A cable 192 is coupled to the locking member 188 and extends from the second adjustment assembly 180 through (or along) the upright support 124 to the release mechanism 166 of the actuator assembly 160. More specifically, a first end of the cable 192 is coupled to the locking member 188 (FIGS. 8 and 9), and a second end of the cable 192 is coupled to the release mechanism 166 (FIGS. 4-7).

In operation, when a user desires to move the exercise handle 125 to a different position, the user actuates the handle portion 162 of the actuation assembly 160 which, in turn, applies tension in the actuation member 164. The actuation member 164 stretches the return spring 168 and disengages the engagement portion 170 from the indexing member 142, thereby releasing the first adjustment assembly 140. The actuation member 164 also tensions the cable 192 and disengages the locking member 188 from one of the indexing slots 186 of the indexing bracket 184, thereby releasing the second adjustment assembly 180. With the engagement portion 170 of the first adjustment assembly 140 disengaged (e.g. while holding the handle portion 162 in an actuated position), the user may adjust the position of the arm 122 with respect to the user. For example, in some embodiments, the user may adjust an elevation angle θ of the arm 122 with respect to the upright support 124. Similarly, with the locking member 188 of the second adjustment assembly 180 disengaged, the user interface is moveable with respect to a longitudinal axis 194, allowing the user to adjust the lateral position of the user interface relative to the user. For example, in some embodiments, the upright support 124 is rotatable about a longitudinal axis 194, allowing the user to adjust an azimuth angle β of the arm 122 about the longitudinal axis 194 of the upright support 124 (FIGS. 8 and 9). Although it is contemplated in the embodiments illustrated in the accompanying figures that the user interface (e.g. exercise handle 125) is adjusted using an arc-like movement, it will be appreciate that in alternate embodiments, the position of the user interface need not be adjusted in an arc, and may be moved linearly or in any other suitable manner.

It will be appreciated that the exercise assembly 100 allows the user to adjust both the vertical position and the horizontal position of the exercise handle 125 (or user interface) by simple actuating the handle portion 162 of the actuator assembly 160. The user may adjust either the vertical position or the horizontal position independently, or the user may adjust both vertical and horizontal positions simultaneously or sequentially as desired.

With the exercise handle 125 in the desired vertical and horizontal position, the user may release the handle portion 162. This allows the return spring 168 of the first adjustment assembly 140 to contract and re-engage the engagement portion 170 with one of the indexing slots 146 of the indexing member 142, and also allows the locking spring 190 of the second adjustment assembly 180 to re-engage the locking member 188 with one of the indexing slots 186 of the indexing bracket 184. With the first and second adjustment assemblies 140, 180 secured in the desired position, the arm 122 is locked in place and the user may perform exercises using the exercise handle 125. More specifically, when the user applies a training force to the exercise handle 125, force is transmitted through the cable-and-pulley assembly to exert force on the selected load (e.g. portion of the weight stack 116). Those portions of the exercise assembly 100 that support the other components involved in the performance of the exercise, and enable the exercise to be performed, may be generally referred to as a support assembly, and may include the central portion 110, the base assembly 104, and any other suitable portions or components of the exercise assembly 100.

Figure 10:
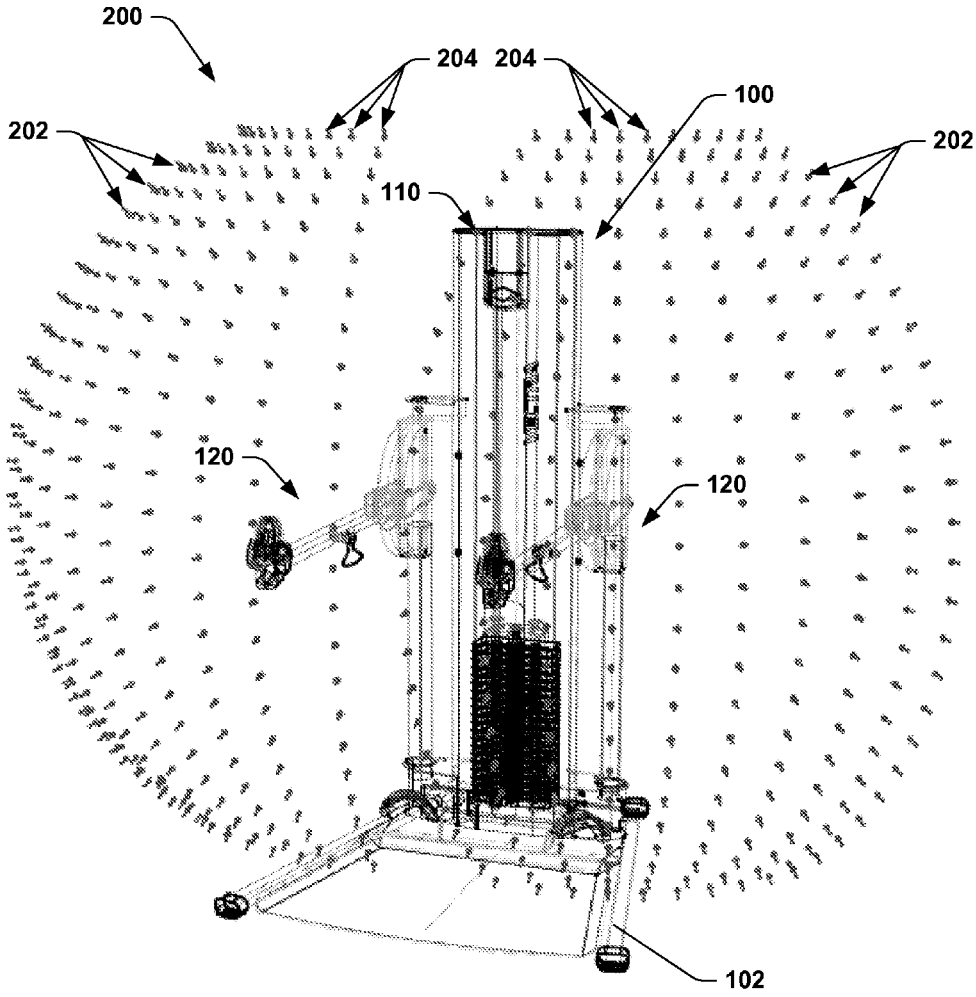
FIG. 10 shows the exercise assembly of FIG. 1 surrounded by an exemplary locus of possible arm positions of the exercising stations that may be achieved using the upper and lower adjustment assemblies in accordance with embodiments of the present disclosure.

FIG. 10 shows the exercise assembly 100 of FIG. 1 surrounded by an exemplary locus 200 of possible arm positions of the exercising stations 120 that may be achieved using the upper and lower adjustment assemblies 140, 180 in accordance with embodiments of the present disclosure. In this embodiment, the position locus 200 is illustrated as intersection points between a plurality of elevational rows 202 and a plurality of azimuthal columns 204. Of course, in alternate embodiments, the positions within the position locus 200 may be distributed in a variety of different ways depending on, for example, the configuration of the one or more adjustment assemblies, and may include random positions, non-uniform positions, or any other suitable distribution of possible positions of the user interface. Embodiments of apparatus in accordance with the present disclosure allow the user to move the arm 122 after activating the handle portion 162 directly to any one of the possible arm positions of the position locus 200 (FIG. 10) without first setting either elevation or azimuth.

In some embodiments, the number (and spacing) of the elevational rows 202 of the position locus 200 may be determined by the number (and spacing) of the indexing slots 146 (FIG. 3) of the arcuate indexing member 142. Similarly, the number (and spacing) of the azimuthal columns 204 may be determined by the number (and spacing) of the indexing slots 186 (FIG. 9) of the indexing bracket 184. In alternate embodiments, a greater or fewer number of rows 202 and columns 204, or a different spacing (or density) of rows 202 and columns 204, may be achieved by altering the number (and spacing) of the indexing slots 146, 186.

After adjustment of one or more of the exercise stations 120, the user may perform a desired exercise using the exercise assembly 100. More specifically, the user may apply a training force on the exercise handle 125 (FIG. 1). As noted above, the exercise handle 125 is coupled to the weight stack 116 via a force-transfer assembly. A variety of different force-transfer assemblies may be used to couple the exercise handle 125 to the weight stack 116 or other suitable training load.

Figure 11:
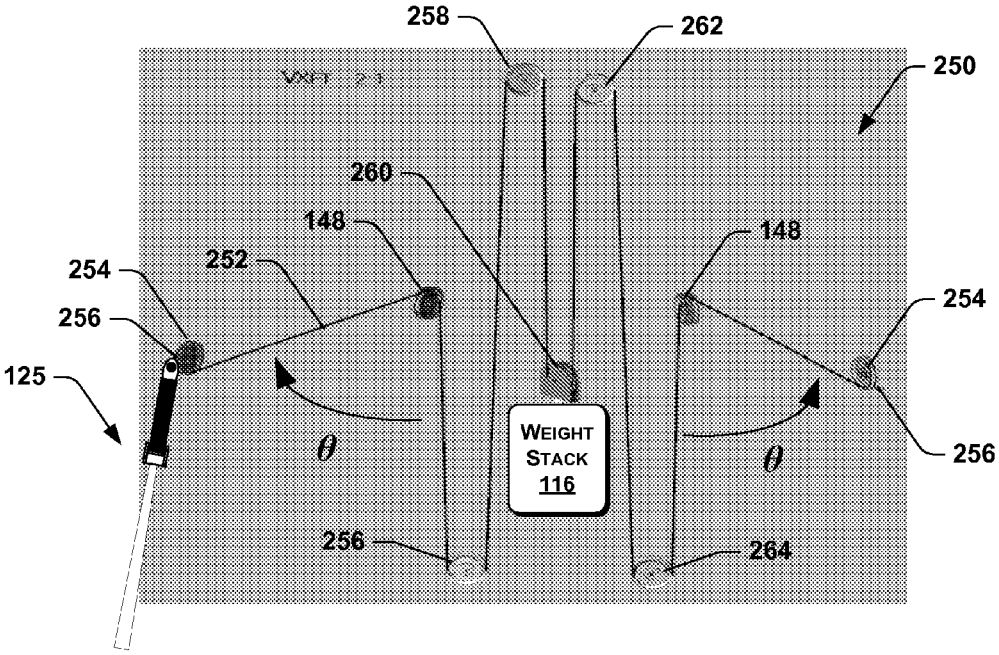
FIG. 11 is a cable-and-pulley assembly of the exercise assembly of FIG. 1.

For example, FIG. 11 is an exemplary cable-and-pulley assembly 250 of the exercise assembly 100 of FIG. 1. In this embodiment, a cable 252 has a first end coupled to the exercise handle 125. The cable 252 is operatively engaged with (or reeved over) an interface pulley 254 coupled to a distal end of the arm 122. The cable 252 then engages the upright guide pulley 148 and extends downwardly to engage over a first fixed pulley 256. The cable 252 then extends upwardly to operatively engage a second fixed pulley 258, and extends downwardly to a central pulley 260 coupled to the weight stack 116. From the central pulley 260, the cable 252 extends upwardly to a third fixed pulley 262, then downwardly again to a fourth fixed pulley 264. The second and third fixed pulleys 258, 262 are attached within an upper portion of the central portion 110 above the weight stack 116.

Finally, the cable 252 extends upwardly to the upright guide pulley 148, and outwardly along the arm 122 to another interface pulley 254 of the other exercise station 120. Stops 256 are associated with the user interface (e.g. exercise handle 125) to prevent retraction of the cable 252 and to maintain tension within the cable 252 during exercises. The structural and operational aspects of the stops 256 are generally known, as described in U.S. Pat. No. 6,582,346 issued to Lines et al., U.S. Pat. No. 6,482,135 issued to Ish et al., and U.S. Pat. No. RE 34,572 issued to Johnson et al., which patents are incorporated herein by reference.

Figure 12:
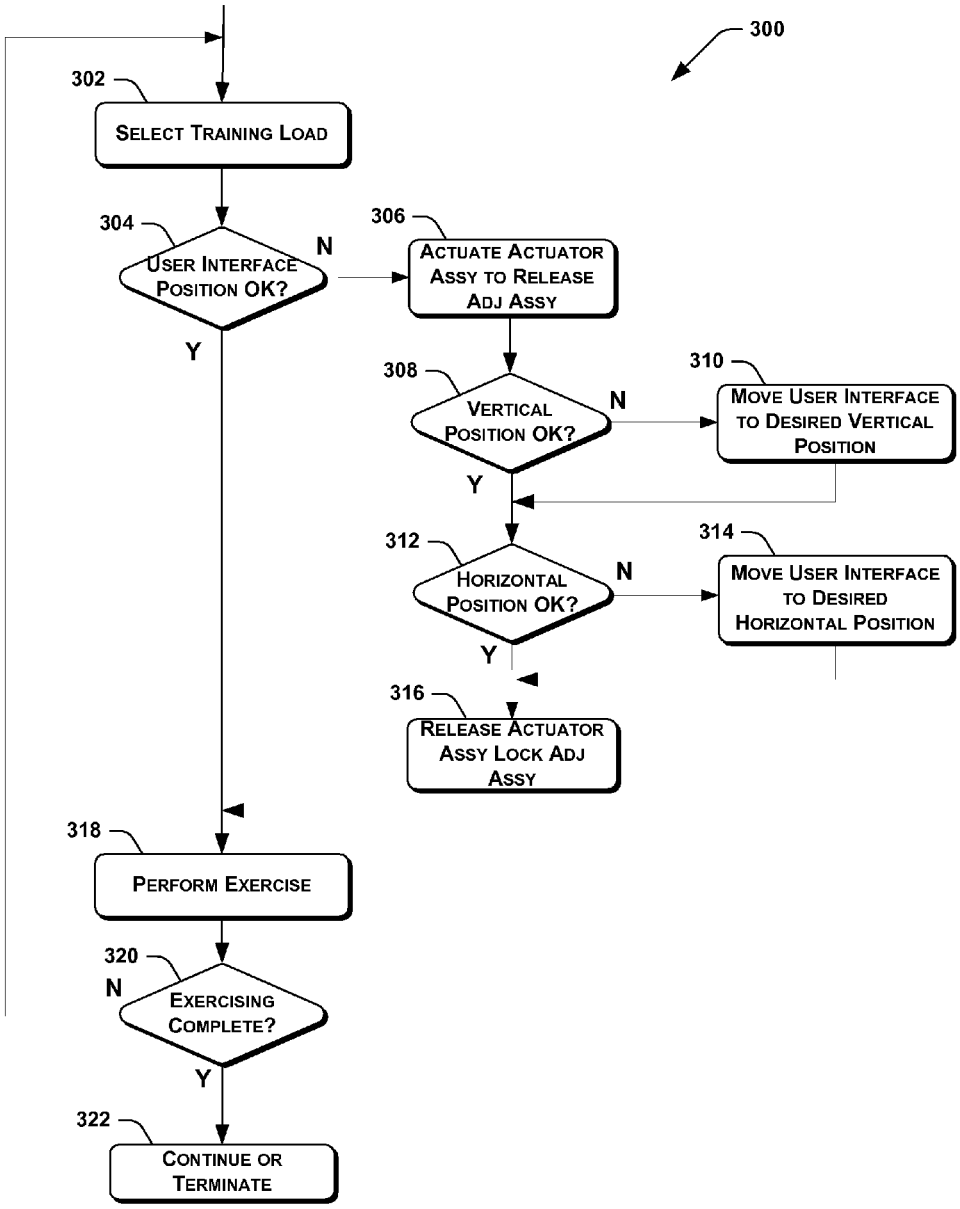
FIG. 12 is a flow chart showing a method of exercising in accordance with another embodiment of the invention.

FIG. 12 is a flow chart showing an exemplary method 300 of exercising in accordance with an embodiment of the invention. For convenience, the method 300 will be described with reference to the exemplary exercise assembly 100 described above and shown in FIGS. 1-11. It will be appreciated, however, that the methods disclosed herein may be practiced with other embodiments of exercising apparatus, and that such methods are not limited to the particular embodiments of exercise assemblies described herein. Furthermore, in the following discussion of methods in accordance with the present disclosure, the order of the acts described is not important, and unless otherwise specified, the order of the acts described may occur in any suitable order.

In the exemplary method 300, a user selects a training load (e.g. a portion of the weight stack 116) for performing an exercise at 302. At 304, the user determines whether a position of a user interface of an exercising station is acceptable. If the position of the user interface is acceptable, then the user proceeds to performing an exercise at 318.

If the position of the user interface is not acceptable (at 304), then the user actuates an actuator assembly to disengage one or more adjustment assemblies at 306. As described above, in some embodiments, the actuation of the actuator assembly at 306 disengages first and second adjustment assemblies.

At 308, the user determines whether a vertical position of the user interface is acceptable, and if not, the user moves the user interface to a desired vertical position at 310. For example, in some embodiments, the adjustment of the user interface into the desired vertical position is accomplished by moving an arm into a desired elevation angle θ. Similarly, at 312, the user determines whether a horizontal position of the user interface is acceptable, and if not, the user moves the user interface to a desired horizontal position at 314. In some embodiments, the adjustment of the horizontal position of the user interface is accomplished by moving an arm into a desired azimuth angle β.

Next, the user may release (or otherwise de-actuate) the actuator assembly at 316, thereby locking the one or more adjustment assemblies to secure the user interface in the desired position. With the user interface secured in the desired position, the user may perform an exercise at 318. At 320, the user decides whether exercises are complete. If not, then the method 300 returns to 302, and the above-described activities (302-318) may be repeated indefinitely. When exercises are complete (at 320), then the method 300 terminates or continues to other activities at 322.

The adjustment of the vertical position of the user interface at 310 may involve a noteworthy aspect of the exercise station 120 described above. More specifically, for embodiments of exercise assemblies 100 wherein the pulley rotation axis 149 is offset from the pivot axis 152 of the arm 122 (as shown in FIG. 2), a change in the elevation angle θ of the arm 122 may cause a non-axial displacement of the cable 252 within the fork member 150 and the arm 122. As best shown in cross-sectional view A-A in FIG. 5, during variation of the elevation angle θ of the arm 122, the cable 252 of the cable-and-pulley assembly 250 (FIG. 11) may traverse in an upward or downward direction 253, 255. It will be appreciated that the cable 252 and the arrows 253, 255 are not drawn to scale, but rather, are sized to clearly illustrate the non-axial movement of the cable 252 within the arm 122. It will also be appreciated that the actuation member 164 of the actuation assembly 160 (FIG. 6), as well as other structures, have been omitted from view A-A of FIG. 5 for clarity. Thus, in such embodiments, the cross-sectional shape of the arm 122 (and the fork member 150) provides internal space for the non-axial movement of the cable 252, as shown in view A-A of FIG. 5. In still other embodiments, the cable 252 may be positioned outside the arm 122.

Figure 15:
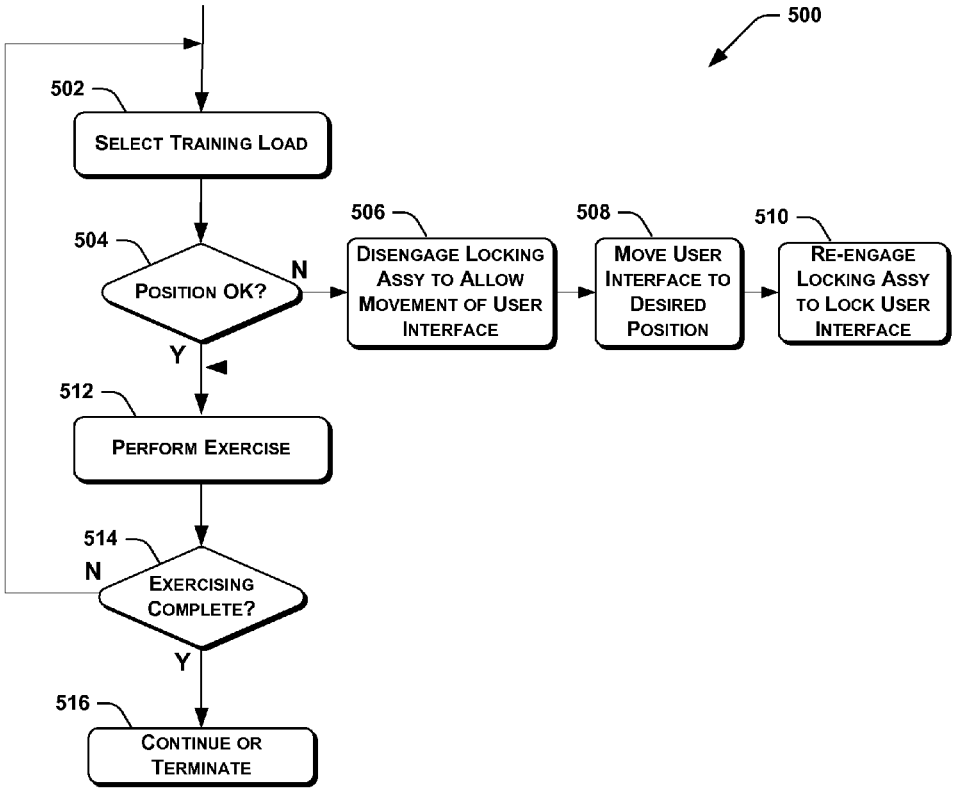
FIG. 15 is a flow chart showing a method of exercising in accordance with yet another embodiment of the invention.

FIG. 15 is a flow chart showing another exemplary method 500 of exercising in accordance with an alternate embodiment of the invention. In this embodiment, the method 500 includes selecting a training load for performing an exercise at 502. At 504, the user determines whether a position of a user interface of an exercise station is acceptable. If so, then the user may proceed to performing an exercise at 512.

If the user interface is not in an acceptable position (at 504), then the user disengages a locking assembly to allow the user interface to be moved to a desired position at 506. The user may move the user interface to the desired position at 508. As noted above, in some embodiments, the position of the user interface may be adjusted by varying an elevation angle θ or an azimuth angle β, or both elevation and azimuth angles θ, β of an outwardly-extending arm of the exercise station.

As noted above, during movement of the user interface at 508, the user may adjust the vertical and horizontal positions of the user interface simultaneously, sequentially, or a combination of both. More specifically, in some embodiments, the user may vary the elevation and azimuth angles θ, β of an arm simultaneously or sequentially, or combinations of both.

With continued reference to FIG. 15, after the user interface is moved to the desired position (at 508), the user may re-engage the locking assembly at 510, thereby locking the user interface in the desired position. An exercise may then be performed at 512. At 514, a determination is made whether exercises are complete. If not, then the method 500 returns to the selecting of the training load (at 502), and the above-described activities (502-514) are repeated until all exercises are complete. When all exercises have been completed (at 514), then the method 500 terminates or continues to other activities at 516.

Figure 13:
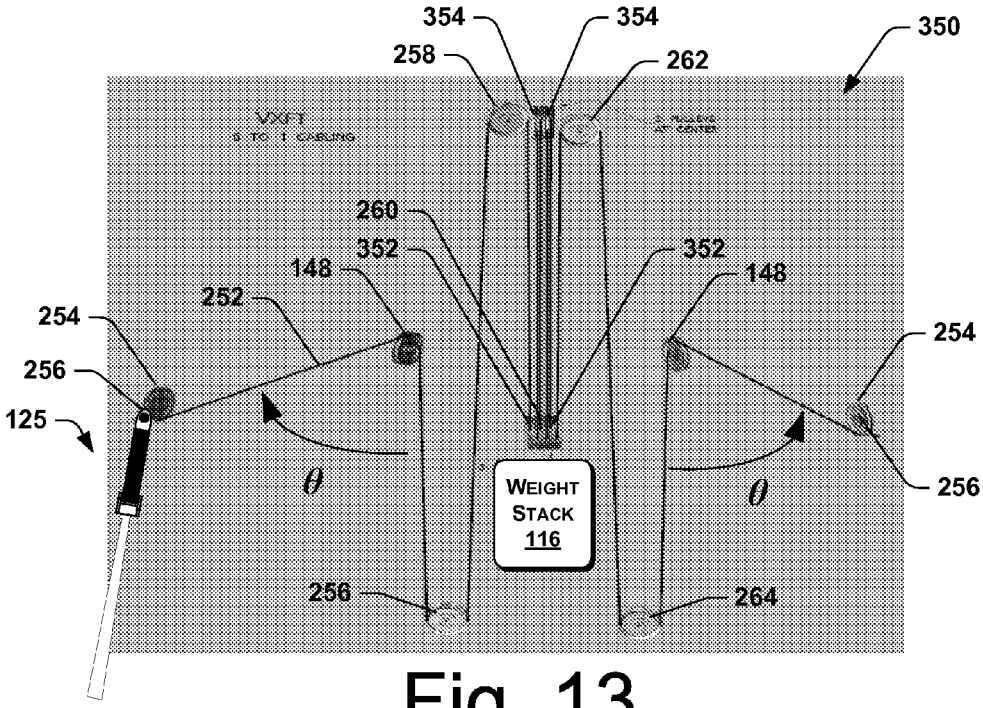
FIG. 13 is an alternate embodiment of a cable-and-pulley assembly that may be used with the exercise assembly of FIG. 1.

It will be appreciated that a variety of alternate embodiments may be conceived, and that the invention is not limited to the particular embodiments described above. For example, FIG. 13 shows an alternate embodiment of a cable-and-pulley assembly 350 that may be used in the exercise assembly of FIG. 1. It will be appreciated that the cable-and-pulley assembly 350 includes many of the same components as the cable-and-pulley assembly 250 described above and shown in FIG. 11. For the sake of brevity, only new aspects or components of the cable-and-pulley assembly 350 will be described.

In the embodiment shown in FIG. 13, the cable-and-pulley assembly 350 includes a pair of auxiliary pulleys 352 positioned proximate the central pulley 260, and a pair of second auxiliary pulleys 354 positioned proximate the second and third fixed pulleys 258, 262. The cable-and-pulley assembly 350 provides a different force ratio than the previously-described embodiment (i.e. cable-and-pulley assembly 250) so that the characteristics of the exercise assembly 100 may be modified as desired. In further embodiments, a greater or fewer number of auxiliary pulleys 352, 354 (e.g. two auxiliary pulley 352 and a single second auxiliary pulley 354) may be used to create still other cable-and-pulley assembly embodiments for use in alternate embodiments of exercise assemblies in accordance with the teachings of the present disclosure.

Figure 14:
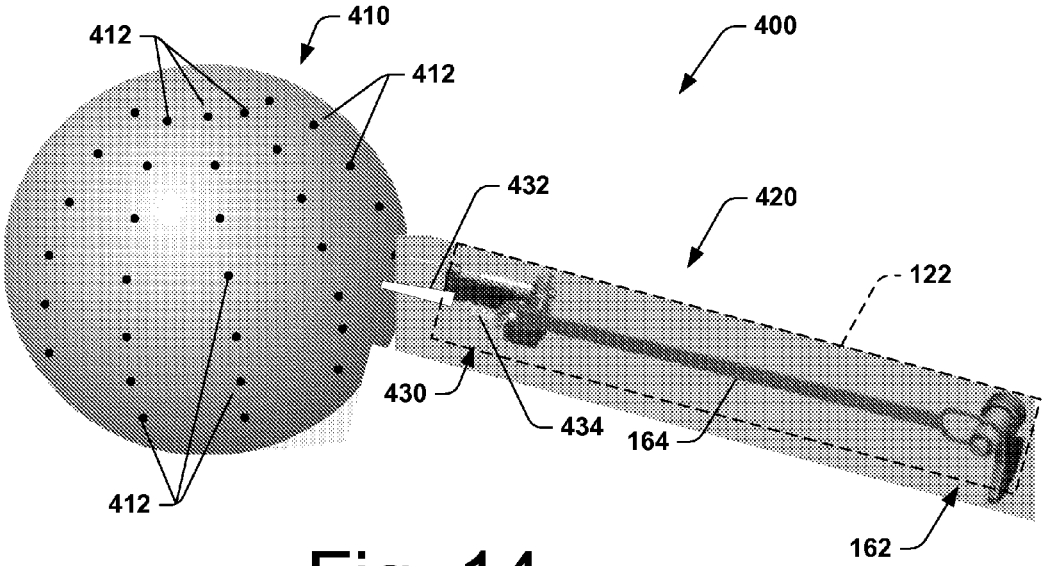
FIG. 14 is an isometric, partially-exploded view of a multi-angle adjustment assembly in accordance with another alternate embodiment of the invention.

In addition, a variety of alternate embodiments of the adjustment assemblies 140, 180 may be conceived in accordance with the teachings of the present disclosure. For example, FIG. 14 is an isometric, partially-exploded view of a multi-angle adjustment assembly 400 in accordance with another alternate embodiment of the invention. In this embodiment, the multi-angle adjustment assembly 400 provides a capability to adjust either the elevation angle θ or the azimuth angle β independently, or to adjust both the elevation and azimuth angles θ, β simultaneously, using a single adjustment assembly.

As shown in FIG. 14, the multi-angle adjustment assembly 400 includes a base member 410 having a plurality of indexing holes 412 disposed therein. The base member 410 is desirably a non-planar member, and in some embodiments, comprises a spherical or partially-spherical member. The indexing holes 412 are distributed over the surface of the base member 410. In alternate embodiments, the positions of the indexing holes 412 may be distributed in a variety of different ways, include non-uniform positions, or any other suitable distribution of possible positions of the user interface. Alternately, using other forms of indexing, the holes 412 may be eliminated, and the possible positions may include any random positions of the user interface as desired.

The multi-angle adjustment assembly 400 further includes an actuation assembly 420 disposed within (or along) the arm 122. The actuation assembly 420 includes a handle portion 162 and an actuation member 164 as described above. A release mechanism 430 is coupled to the actuator and is selectively engageable with the base member 410. More specifically, in this embodiment, the release mechanism 430 includes an engagement pin 432 biased in a forward direction (toward the base member 410) by a biasing spring 434. The engagement pin 432 is selectively engageable with the indexing holes 412 by rotating the handle portion 162 of the actuation assembly 420.

When the multi-angle adjustment assembly 400 is used in the place of the first and second adjustment assemblies 140, 180, the indexing holes 412 of the base member 410 may define both the elevational and azimuthal positions (angles θ, β) of the arm 122. In operation, a method of exercising using the multi-angle adjustment assembly 400 may substantially as described above with respect to the methods 300, 500 shown in FIGS. 12 and 15, including adjusting the elevational angle θ and the azimuthal angle β simultaneously or sequentially as desired.

In an alternate embodiment, the multi-angle adjustment assembly 400 may be re-configured such that the base member 410 may be moveable with the arm 122, and the engagement pin 432 may remain at a fixed location. In such an embodiment, the actuator assembly 420 may be de-coupled from the arm 122, and may be actuated by the user in a variety of ways, such as by using a foot pedal, a spring-loaded pin assembly, or any other suitable way. Alternately, the adjustment assembly 400 may be re-configured such that the base member 410 remains fixed, and the engagement pin 432 selectively engages with the indexing holes 412 of the base member 410 from the inner side, that is, the side opposite from arm 122. In other embodiments, the engagement pin 432 and indexing holes 412 may be replaced by other, frictionally-engageable locking devices.

Embodiments of apparatus and methods in accordance with the teachings of the present disclosure may provide significant advantages over the prior art. For example, embodiments of the present disclosure may provide improved adjustability of the position of the user interface, thereby providing improved exercise capabilities for the user. In this way, functional-training movements associated with a user's chosen activity may be more accurately simulated, including movements associated with sports, or movements associated with a user's work, hobby, or therapeutic activities. Also, movement of the user interface may be easily and efficiently performed. Embodiments of the present disclosure provide the desired capabilities using efficient and relatively-inexpensive adjustment assemblies.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An exercise assembly, comprising:

a load;

a support assembly operatively positioned relative to the load;

a force-transferring assembly operatively coupled to the load and to the support assembly; and an exercise station operatively coupled to the force-transferring assembly, the exercise station including:

a user interface;

at least one adjustment assembly configured to adjust a position of the user interface;

an actuator assembly selectively engageable with the at least one adjustment assembly, the actuator assembly having a single actuator handle configured to enable adjustment of both elevational and azimuthal angles of the user interface when the single actuator handle of the actuator assembly is actuated to release the at least one adjustment assembly, and to disable adjustment of both elevational and azimuthal angles of the user interface when the single actuator handle of the actuator assembly is actuated to lock the at least one adjustment assembly; and an outwardly-extending arm having a longitudinal axis and operatively coupled between the user interface and the at least one adjustment assembly, the single actuator handle being positioned at a distal location on the arm, the single actuator handle being coupled to an actuation member that is arranged to slideably engage and disengage a rotational portion of the adjustment assembly to enable and disable adjustment of at least one of an elevation angle and an azimuth angle of the arm, and wherein the actuation member is further arranged to slideably engage and disengage the rotational portion of the adjustment assembly in a direction substantially parallel to or along the longitudinal axis of the outwardly-extending arm.

2. The exercise assembly of claim 1, wherein the rotational portion of the adjustment assembly includes an arcuate indexing member arranged to control the elevation angle of the arm.

3. The exercise assembly of claim 1, wherein the at least one adjustment assembly includes a first adjustment assembly configured to provide adjustability of an elevation angle of the arm, and a second adjustment assembly configured to provide adjustability of the azimuth angle of the arm.

4. The exercise assembly of claim 1, wherein the at least one adjustment assembly comprises first and second adjustment assemblies, and wherein the actuator assembly is further configured to release the first and second adjustment assemblies, and lock the first and second adjustment assemblies.

5. The exercise assembly of claim 1, wherein the at least one adjustment assembly includes:

a base member having a plurality of indexing holes disposed therein; and wherein the actuator assembly comprises:

a locking mechanism having an indexing pin engageable into one or more of the plurality of indexing holes; and a biasing member configured to bias the indexing pin into engagement with the one or more of the plurality of indexing holes.

6. The exercise assembly of claim 5, wherein the exercise station further includes an outwardly-extending arm operatively coupled to the at least one adjustment assembly, the user interface being positioned on the arm and the at least one adjustment assembly being configured to adjust an elevation angle and an azimuth angle of the arm.

7. The exercise assembly of claim 5, wherein the actuator assembly further includes a handle portion operatively coupled to the locking mechanism such that rotation of the handle portion in a first rotational direction from an initial position disengages the indexing pin from the base member, and rotation of the handle portion in a second rotational direction re-engages the indexing pin into one or more of the plurality of indexing holes.

8. The exercise assembly of claim 5, wherein the base member comprises a partially-spherical member.

9. The exercise assembly of claim 1, wherein when the force-transferring assembly includes a cable-and-pulley assembly.

10. A method of performing an exercise, comprising:

selecting a training load;

actuating an actuator to enable movement of a user interface of an exercise station, wherein actuating the actuator includes actuating a single actuator handle to disengage a locking pin from an adjustment assembly to enable movement along both elevational and azimuthal angles of the user interface, wherein the locking pin is disengaged by moving the locking pin in a plane that is defined by an azimuthal column associated with an instant location of the exercise station, wherein the exercise station includes an outwardly-extending arm having a longitudinal axis and being operatively coupled between the user interface and the at least one adjustment assembly; and wherein actuating a single actuator handle to disengage a locking pin from an adjustment assembly includes actuating a single actuator handle to slideably disengage the locking pin from a portion of the adjustment assembly in a direction substantially parallel to or along the longitudinal axis of the arm to enable adjustment of at least one of an elevation angle and an azimuth angle of the arm;

moving the user interface to a desired position;

actuating the actuator, including de-actuating the single actuator handle to engage the locking pin with the adjustment assembly, to prevent movement of the user interface; and applying a training force to the training load via the user interface.

11. The method of claim 10, wherein the exercise station includes an arm operatively coupled to the at least one adjustment assembly, and wherein enabling movement of the user interface includes enabling movement of the arm.

12. The method of claim 10, wherein the exercise station includes a first adjustment assembly that enables vertical movement of the user interface, and a second adjustment assembly that enables horizontal movement of the user interface, and wherein actuating the actuator includes releasing both the first and second adjustment assemblies.

13. The method of claim 10, wherein the at least one adjustment assembly includes a base member having a plurality of indexing holes disposed therein, and wherein actuating an actuator includes withdrawing an indexing pin from one or more of the plurality of indexing holes.

14. The method of claim 10, wherein moving the user interface to a desired position includes simultaneously adjusting a vertical position and a horizontal position of the user interface.

15. The method of claim 10, wherein moving the user interface to a desired position includes sequentially adjusting a vertical position and a horizontal position of the user interface.

16. The method of claim 10, wherein actuating an actuator includes rotating a handle portion of the actuator.

17. The method of claim 12, wherein the exercise station includes an arm coupled to the user interface, the first adjustment assembly being configured to enable adjustment of an elevation angle of the arm, and the second adjustment assembly being configured to enable adjustment of an azimuth angle of the arm.

18. The method of claim 13, wherein the exercise station further includes an outwardly-extending arm operatively coupled to the at least one adjustment assembly, the user interface being positioned on the arm, and wherein enabling movement of the user interface includes enabling variation of both an elevation angle and an azimuth angle of the arm.

* * * * *